United States Patent [19]

Taylor et al.

[11] Patent Number: 4,665,667

[45] Date of Patent: May 19, 1987

[54] FASCIA INCLUDING MEANS FOR RIGIDLY SECURING A MEMBRANE IN PLACE

[76] Inventors: William T. Taylor, 4805 N. Hollywood, Whitefish Bay, Wis. 53217; Bennie L. Lane, W347 S7194 Sprague Rd., Eagle, Wis. 53119

[21] Appl. No.: 862,463

[22] Filed: May 12, 1986

Related U.S. Application Data

[63] Continuation-in-part of Ser. No. 796,290, Nov. 8, 1985, abandoned.

[51] Int. Cl.[4] ..... E04D 13/15

[52] U.S. Cl. ..... 52/96

[58] Field of Search ..... 52/94, 95, 96, 60

[56] References Cited

U.S. PATENT DOCUMENTS

| | | | |
|---|---|---|---|
| 3,365,847 | 1/1968 | Josek | 52/94 |
| 4,037,372 | 7/1977 | Patry | 52/96 |
| 4,335,546 | 6/1982 | Kelly | 52/96 |
| 4,437,283 | 3/1984 | Benoit | 52/96 |
| 4,598,507 | 7/1986 | Hickman | 52/96 |

FOREIGN PATENT DOCUMENTS

| | | | |
|---|---|---|---|
| 1784213 | 8/1977 | Fed. Rep. of Germany | 52/94 |

*Primary Examiner*—John E. Murtagh

*Attorney, Agent, or Firm*—Michael, Best & Friedrich

[57] ABSTRACT

A fascia for securing a rubber membrane against the surface of a roof, the fascia including a rigid planar plate portion adapted to be secured to the generally vertical edge portion of the roof and to clampingly engage a portion of the rubber membrane to secure the rubber membrane against the vertical surface, and a rigid flange projecting from the planar plate portion and including a lower surface adapted to engage a portion of the membrane supported by the surface of the roof adjacent the edge and to secure the membrane against the upper surface of the roof.

5 Claims, 4 Drawing Figures

FASCIA INCLUDING MEANS FOR RIGIDLY SECURING A MEMBRANE IN PLACE

This application is a continuation-in-part of U.S. patent application Ser. No. 796,290, filed Nov. 8, 1985 and, now abandoned.

FIELD OF THE INVENTION

The invention relates to rubber roof membranes and to apparatus for use in securing rubber roof membranes in place.

BACKGROUND PRIOR ART

Large rubber membranes are commonly used for covering a roof such as a flat roof. The membrane may be laid over the surface of the roof and secured in place by adhesive or mechanical fastening means. An example of a suitable fastening means for securing the membrane in place is described in the Lane U.S. Pat. No. 4,543,758, issued Oct. 1, 1985.

Prior art mechanisms have also been provided for securing the edges of a rubber roof membrane in place to the edges of the roof. One apparatus for securing a membrane in place is described in the Butzen U.S. Pat. No. 4,419,850, issued Dec. 13, 1983.

In some applications the rubber membrane may be subjected to large wind forces causing the rubber membrane to tend to pull away from the surface of the roof, and in these applications, it is necessary to provide a means for rigidly securing the edge of the rubber membrane in place to prevent the edge of the membrane from pulling away from the edge of the roof.

In some applications the edges of the rubber membrane may be held down by placing cast paver blocks on the membrane at the edges of the roof. The paver blocks generally comprise cast square concrete blocks, approximately 1½ to 2 inches thick and 2 feet on a side. The paver blocks are placed on the membrane in edge to edge relation and cover at least that portion of the membrane adjacent the edge of the roof. While the paver blocks are relatively heavy, in some applications the wind forces against the building may tend to lift the edges of the paver blocks more closely adjacent the edge of the roof. This may result in damage to the paver blocks, and movement of the paver blocks on the membrane can cause the peripheral edges of the paver blocks, or sharp edges created by fracture of the blocks, to cut or abrade the rubber membrane.

Attention is also directed to the Wolma U.S. Pat. No. 4,083,158, issued Apr. 11, 1978; the Berg U.S. Pat. No. 3,432,976, issued Mar. 18, 1969; the Gobel U.S. Pat. No. 3,444,658, issued May 20, 1969; and the Gobel U.S. Pat. No. 3,507,470, issued Apr. 21, 1970.

Attention is also directed to the Fischer, Jr. et al. U.S. Pat. No. 3,680,269, issued Aug. 1, 1972; the Monroe U.S. Pat. No. 3,815,302, issued June 11, 1974; the Simpson, Jr. U.S. Pat. No. 3,404,495 issued Oct. 8, 1968; the Patry U.S. Pat. No. 4,307,372, issued July 26, 1977; and the Hellebrand U.S. Pat. No. 3,389,515, issued June 25, 1968.

SUMMARY OF THE INVENTION

The present invention provides an improved apparatus for securing the periphery of a rubber membrane to the edge of a roof and such that the rubber membrane is firmly clamped in place against the surface of the roof and will not pull up as a result of wind forces on the membrane. More particularly, the apparatus embodying the invention comprises a fascia including a rigid generally planar plate portion adapted to be secured to the vertical surface of the edge of the roof, the rigid planar plate having a generally planar rearward surface intended to engage an edge portion of the rubber membrane extending downwardly from the edge of the roof and to clamp the edge of the membrane against the vertical surface at the edge of the roof. The fascia also includes a flange extending from the rearward surface of the rigid planar plate and providing a means for clamping that portion of the rubber membrane adjacent the edge of the roof down against the upper surface of the roof in fixed relation. In a preferred form of the invention, the flange is integrally joined to the vertical plate and is rigid with respect to the vertical plate. Means are also provided for securing the fascia to the vertical wall such that the vertical portion clamps the edge of the rubber membrane against the wall and such that the horizontally projecting flange clampingly engages the rubber membrane and forces it down against the surface of the roof to clamp it in place.

In one preferred embodiment of the invention, the means for securing the fascia to the vertical wall includes a plurality of screws extending through apertures provided in the vertical plate portion and into the vertical wall below the surface of the roof.

In a preferred form of the invention, the fascia also includes means for supporting a cover plate such that the cover plate can snap onto the face of the fascia and be resiliently held against the fascia. This means can include a first flange extending from an upper edge of the vertical plate portion of the fascia and a second flange extending from a lower edge of the vertical plate. The flanges extend outwardly away from the edge of the roof and diverge with respect to one another. A cover plate is also provided including one edge portion adapted to be hooked over one of the flanges of the fascia and a second edge portion adapted to snap over the edge of the other of the flanges.

In one embodiment of the invention the fascia system also provides an improved means for securing paver blocks in place when paver blocks are placed on the membrane adjacent the edge of the roof. In such an embodiment of the invention the fascia system includes a second projecting flange adapted to extend over an upper edge portion of the paver blocks and such that the edges of the paver blocks adjacent the edge of the roof are housed between the flange engaging the rubber membrane and holding it down against the surface of the roof and the second flange. The second flange prevents the edge of the paver block from being lifted up away from the edge of the roof. Since the edge of the paver block is housed in a channel defined by the fascia system, wind is precluded from getting under the edge of the paver block or from applying an upward force on the paver block.

Various other features and advantages of the invention will be apparent from reference to the following description of a preferred embodiment, from the claims and from the drawings.

Figure 1:
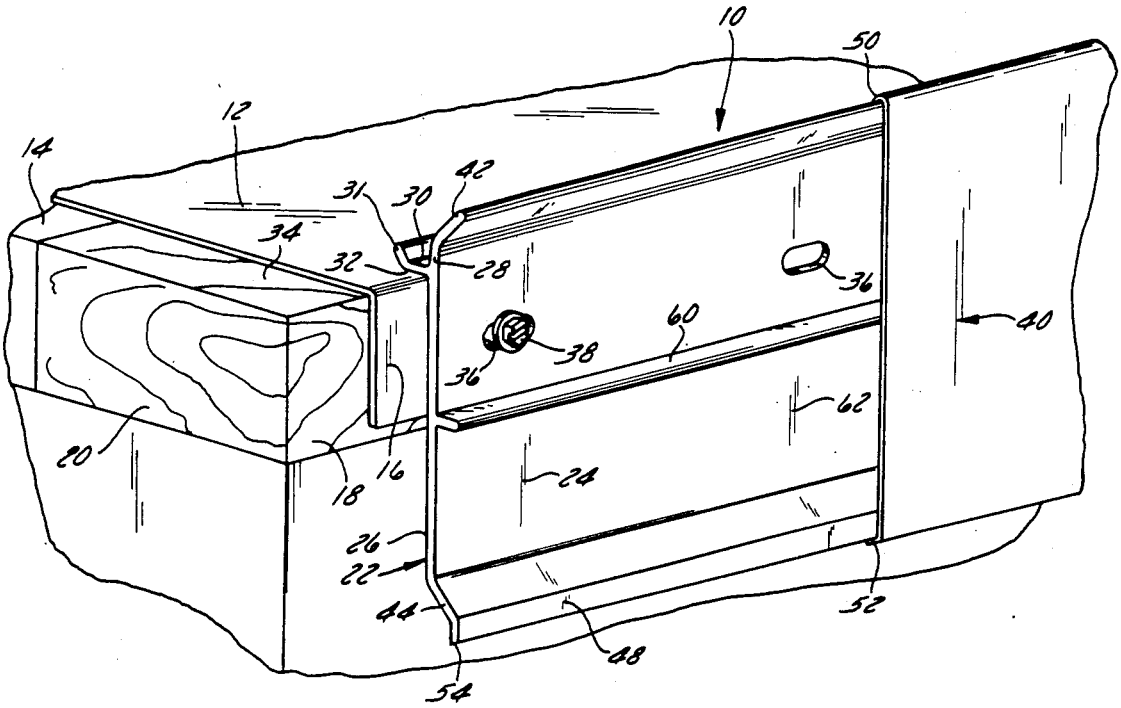
FIG. 1 is a perspective view of the fascia assembly embodying the present invention and with portions cut away, the fascia assembly being illustrated as clamping the rubber membrane against a roof surface.

Before explaining one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 is a fascia assembly 10 adapted to secure the edge of a rubber membrane 12 to the surface 14 of a flat roof. The rubber membrane 12 is supported by the flat generally horizontal upper surface 14 of a roof, and the edge 16 of the membrane 12 extends over the vertical face 18 of a conventional wooden nailer 20 and such that the projecting or extending portion 16 of the membrane 12 can be secured against the vertical face 18 of the nailer 20.

The fascia assembly 10 includes an elongated rigid fascia 22 adapted to extend along the edge of the roof and to secure the rubber membrane 12 to the nailer 20 and to thereby prevent the edge of the rubber membrane 12 from pulling upwardly away from the edge of the roof. The fascia 22 comprises a rigid plate 24 including a generally planar rearward surface 26 adapted to engage that portion 16 of the rubber membrane 12 folded over the edge of the roof and for clamping that portion of the membrane securely against the vertical face or surface 18 of the nailer 20. In the illustrated arrangement, a portion 28 of the vertical plate 24 extends above the surface 14 of the roof, and the remainder of the vertical plate includes a rearward face or surface adapted to engage the vertical face 18 of the nailer forming the edge of the roof.

The fascia also includes a rib or flange 30 projecting from the rearward surface 26 of the vertical plate 24, the rearwardly extending flange 30 including a lower surface 32 adapted to engage the rubber membrane 12 and to secure it downwardly against the upper surface 34 of the nailer 20 such that the rubber membrane cannot be pulled away from the surface of the roof or away from the edge of the roof.

In a preferred form of the invention the rib or flange 30 and the plate portion 24 of the fascia are rigid and integrally joined. This construction can be achieved by producing the fascia as an elongated extrusion of material such as aluminum. The aluminum extrusion will produce a rigid structure wherein the flange 30 and plate 24 are substantially inflexible with respect to one another and such that the projecting end of the flange 30 cannot be pulled upwardly away from the surface of the roof in response to an upward force by the membrane 12 against the flange 30.

In a preferred form of the invention the rearwardly extending flange 30 will also include an edge portion 31 extending along its length, the edge portion 31 being inclined upwardly. The inclined edge portion 31 of the flange 30 is joined to the flange by a curved lower surface 33 such that the surface of the flange 30 engaging the rubber membrane does not include sharp corners which might pierce the membrane.

Means are also provided for securing the fascia 22 to the edge of the roof such that the edge of the membrane 12 extending over the edge of the roof will be clamped in place between the rearward planar surface 26 of the plate portion 24 of the fascia 22 and the vertical face 18 of the nailer 20 forming the edge of the roof. The means for securing the fascia 22 in place also causes the flange portion 30 of the fascia to secure the edge of the membrane 12 down against the upper surface of the roof.

While the means for clamping could have various constructions, in the illustrated arrangement a plurality of apertures or slots 36 are provided through the vertical plate portion 24. The apertures 36 are spaced apart along the length of the fascia 22, and screws or bolts 38 can extend through the apertures 36 to rigidly secure the fascia 22 to the wooden nailer 20 forming the edge portion of the roof.

Figure 2:
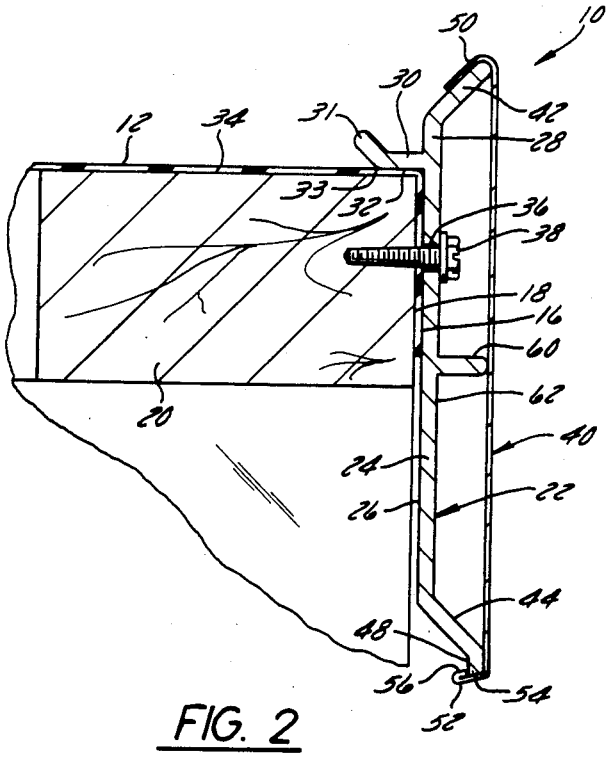
FIG. 2 is an enlarged cross section view taken along line 2—2 in FIG. 1.

When the fascia 22 is in place, as illustrated in FIG. 2, the rearwardly extending flange lower surface 32 clamps the edge of the rubber membrane 12 downwardly against the upper surface 34 of the wooden nailer 20, and the rearward face 26 of the vertical plate portion 24 of the fascia 22 similarly clamps the downwardly extending edge 16 of the rubber membrane 12 firmly against the vertical planar face 18 of the wooden nailer 20. The fascia assembly 10 thus provides a very rigid and secure mechanism for clamping the edge of the rubber membrane against the surface of the roof and provides a firm means for securing the rubber membrane in place and is resistent to even large upward forces on the membrane which might be caused by high winds.

The fascia assembly also includes a cover plate 40 which is adapted to be positioned over the fascia 22 and to provide a decorative cover for the fascia 22 and the screws 38 used to secure the fascia to the edge of the roof. Means are also provided for permitting the cover plate 40 to be secured to the fascia 22 once the fascia is secured in place to the edge of the roof. In the illustrated arrangement, the fascia 32 includes upper and lower edges, the upper edge including a flange portion 42 inclined upwardly and forwardly. The lower elongated edge of the fascia similarly includes a second flange portion 44 which is inclined downwardly and forwardly and which terminates in a downwardly extending lip 48. The fascia cover plate 40 includes an upper edge defining a lip 50 adapted to hook over the upper edge of the flange portion 42 of the fascia 22 to engage that flange portion. The fascia cover plate 40 also includes a lower edge including a resilient lip 52 adapted to be resiliently forced over the lower edge of the lip 48 of the lower flange portion 44. Once the lip 50 has been hooked over the edge of the upper flange 42, the lower hook portion 52 can be forced over the lip 48 and will resiliently hold the fascia cover plate 40. In the illustrated arrangement the lower surface 54 of the lower flange portion 44 is inclined downwardly at an angle of approximately 15°. The rearward portion of the resilient lip 52 is folded over such that as the lip 52 is forced over the lower flange portion, the rearward edge thereof will then engage the rearward surface of the flange portion 44 to prevent removal of the cover plate 40.

In the illustrated construction the fascia 22 also includes a rib 60 extending forwardly from the forward face 62 of the plate 24. The rib 60 functions to support the fascia cover plate 40 and to provide increased rigidity to the fascia 22.

Figure 3:
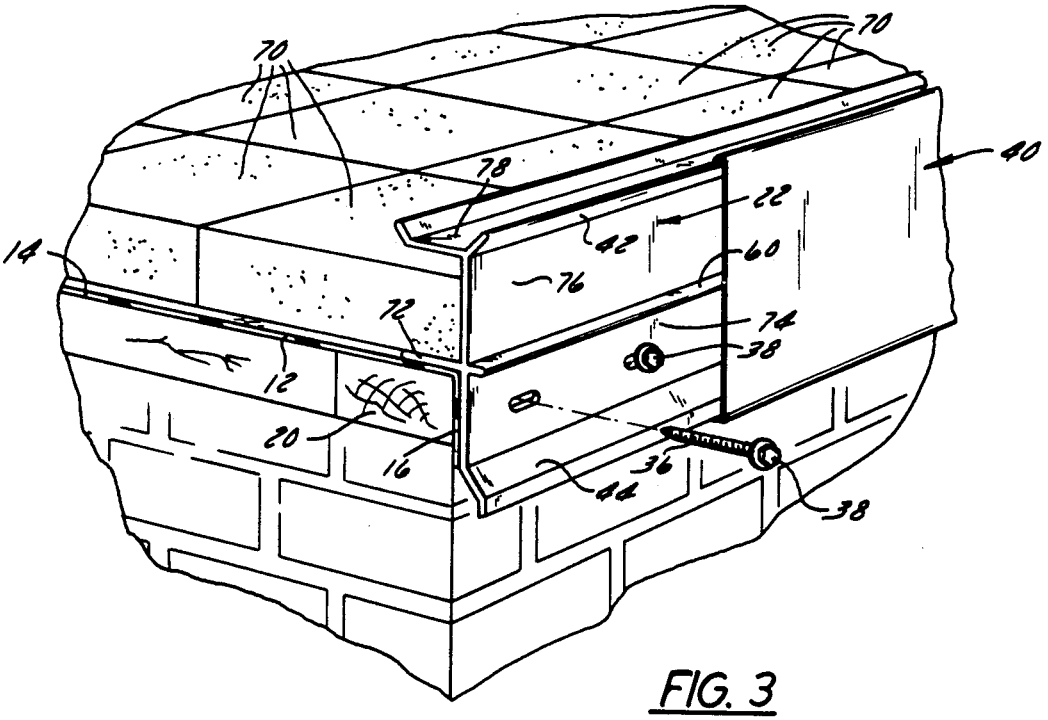
FIG. 3 is a perspective view of a second embodiment of the fascia assembly of the invention, the fascia assembly being illustrated as securing a rubber membrane and a paver block against the edge of a roof.
Figure 4:
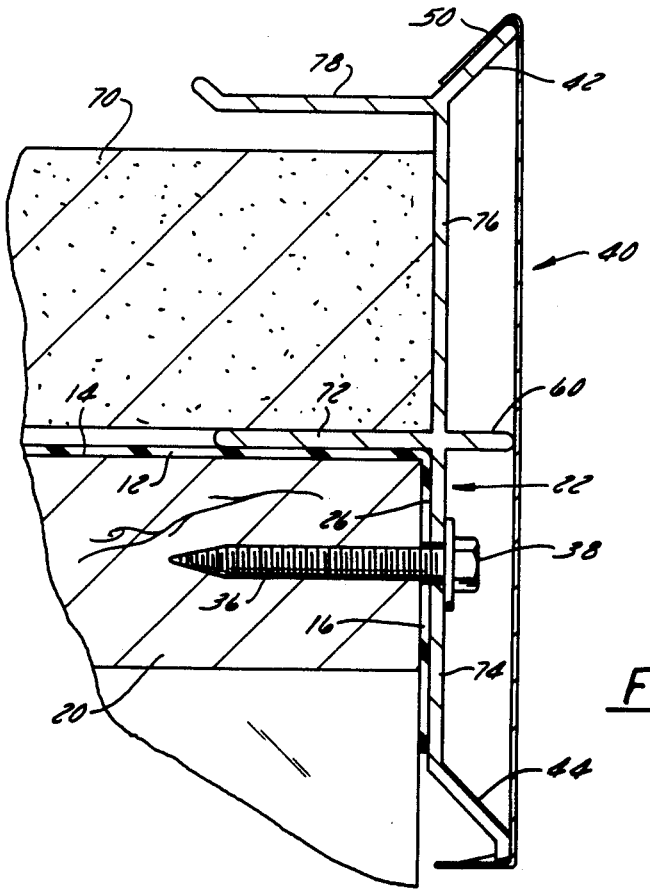
FIG. 4 is an enlarged cross section view of the apparatus shown in FIG. 3.

Illustrated in FIGS. 3 and 4 is an alternative embodiment of the fascia assembly embodying the invention. The fascia assembly shown in FIG. 3 is similar in construction to that shown in FIGS. 1 and 2 with common elements numbered as in FIGS. 1 and 2, but further includes means for holding an edge of a paver block 70 down against the surface of a roof. In the construction shown in FIG. 3 a plurality of paver blocks 70 are provided as weights for holding the rubber membrane 12 down against the surface 14 of the roof. The paver blocks 70 are conventional and may have a thickness of $1\frac{1}{2}$ to 2 inches and be approximately 2 feet wide. The paver blocks 70 are placed together in edge to edge abutting relation to cover at least a substantial portion of the rubber membrane 12 at the edge of the roof.

In the arrangement shown in FIGS. 3 and 4, the fascia assembly includes a rearwardly extending substantially planar flange 72 adapted to overlie the membrane at the edge of the roof and to secure the membrane down against the surface of the roof. The fascia assembly also includes a rigid planar portion 74 adapted to be positioned against the edge 16 of the membrane hanging over the edge of the roof for securing that edge portion of the membrane against the edge of the roof. The rigid planar vertical portion 22 of the fascia further includes a portion 76 coplanar with portion 74 and extending vertically upwardly with respect to the surface of the roof. Integrally joined to an upper edge portion of the upwardly extending portion 76 is a second rearwardly extending flange 78 spaced above the lower flange 72 and extending horizontally in parallel relation to the lower flange 72. The upper rearwardly extending flange 78 is spaced above the lower flange 72 by a distance somewhat greater than the thickness of the paver blocks 70 such that the edges of the paver blocks 70 can be slideably inserted into the gap between the upper and lower flanges 78 and 72.

During installation of a rubber membrane 12 secured in place by the fascia assembly 22 and paver blocks 70, after the rubber membrane 12 is laid over the edge of the roof, the fascia is placed over the edge of the membrane such that the first flange 72 applies a downward force on the membrane and the vertical face 74 of the fascia secures the overhanging edge of the membrane against the vertical face of the wall. The fascia 22 is secured in place by a screw 36 extending into the nailer 20. Paver blocks 70 are then placed on the rubber membrane 12 with edges of the paver blocks 70 being inserted into the space between the lower and upper flanges 72 and 78. This forms a row of paver blocks extending along the periphery of the roof. Additional paver blocks 70 can then be placed on the membrane 12 in abutting relation with the outer peripheral row of paver blocks 70 to provide additional weight on the membrane 12.

Various features of the invention are set forth in the following claims.

We claim:

1. Apparatus for securing a rubber membrane to a roof, the roof having an upper surface and the edge of the roof defining a generally vertical surface, the rubber membrane being supported by the upper surface of the roof and a portion of the membrane extending downwardly adjacent the vertical surface of the edge of the roof, the apparatus comprising a rigid fascia adapted to be secured to the vertical surface of the edge of the roof and to clamp the rubber membrane against the upper surface of the roof and against the vertical surface of the edge of the roof, the rigid fascia including a generally planar vertical portion adapted to engage a portion of the rubber membrane and to secure it against the vertical surface, said generally planar vertical portion positioned in adjacent facing relation to the vertical surface of the edge of the roof, the generally planar vertical portion having a generally planar rearward surface adapted to be positioned in facing relation with respect to the vertical surface of the edge of the roof from the upper surface of the roof downwardly and to secure the edge of the membrane against that vertical surface, and a rearwardly extending flange projecting from the planar rearward surface, said flange being integrally and rigidly connected to said planar vertical portion, and the rearwardly extending flange including a lower surface adapted to engage a portion of the rubber membrane supported by the upper surface of the roof to hold the rubber membrane down against the upper surface of the roof, an upper portion of said planar vertical portion extending above the intersection of the rearwardly extending flange and the planar vertical portion, and said upper portion of said planar vertical portion including an upper flange extending upwardly and forwardly and having an upper edge and said planar vertical portion including a lower flange extending downwardly and forwardly, said lower flange having a lower edge, means for securing the planar vertical portion against the vertical surface of the edge of the roof to cause the portion of the membrane extending downwardly from the upper surface of the roof to be clamped against the vertical surface of the edge of the roof and, cover plate means for covering said rigid fascia, said cover plate means including an upper edge having means for gripping said upper flange and including a lower edge having means for gripping said lower flange.

2. Apparatus as set forth in claim 1 wherein said rearwardly extending flange intersects said planar vertical portion in generally perpendicular relation.

3. Apparatus as set forth in claim 1 wherein said rearwardly extending flange includes an end portion spaced from said planar vertical portion, said end portion extending upwardly away from the upper surface of the roof.

4. Apparatus as set forth in claim 1 wherein said planar vertical portion includes at least one aperture and wherein said means for securing said fascia to said vertical surface includes a fastener extending through said aperture into said vertical surface.

5. Apparatus for securing a rubber membrane to the edge of a roof, the roof having an upper surface, and the edge of the roof defining a generally vertical surface, the rubber membrane being supported by the upper surface of the roof and extending downwardly adjacent a vertical surface of the edge of the roof, and weights supported on the rubber membrane to hold the membrane down against the upper surface of the edge of the roof, the apparatus comprising, a rigid fascia adapted to be secured to the vertical surface of the edge of the roof and for use in clamping the rubber membrane against the upper surface of the edge of the roof and against the vertical surface of the edge of the roof, the rigid fascia including, a generally planar vertical portion adapted to engage a portion of the rubber membrane and to secure it against the vertical surface, means for securing the planar vertical portion against the vertical surface, a first flange projecting from the planar vertical portion and rigidly connected to the planar vertical portion, said first flange including a lower surface adapted to engage the rubber membrane to hold the rubber membrane down against the upper surface of the roof, and means for preventing the weights adjacent the edge of the roof from upward movement away from the rubber membrane, said means including a second flange projecting from an upper portion of the planar vertical portion and rigidly connected to the planar vertical portion, the second flange extending generally parallel to the first flange, and the second flange being adapted to extend over at least a portion of at least one of the weights such that said portion is housed between said second flange and said first flange and is prevented from upward movement away from the roof.

* * * * *